United States Patent [19]

Kosuge et al.

[11] Patent Number: 5,052,684

[45] Date of Patent: Oct. 1, 1991

[54] APPARATUS FOR TRAINING A WAIST PORTION OF A HUMAN BODY

[75] Inventors: Shuichi Kosuge; Chosaku Otaki, both of Tokyo, Japan

[73] Assignee: Senoh Kabushiki Kaisha, Tokyo, Japan

[21] Appl. No.: 94,372

[22] Filed: Sep. 9, 1987

[30] Foreign Application Priority Data

Sep. 10, 1986 [JP] Japan ..... 61-139146[U]

[51] Int. Cl.[5] ..... A63B 21/015

[52] U.S. Cl. ..... 272/132; 272/134; 272/144; 272/146

[58] Field of Search ..... 272/131, 132, 134, 130, 272/140, 93, 118, 117, 129, 136, 144, 146

[56] References Cited

U.S. PATENT DOCUMENTS

| | | | |
|---|---|---|---|
| 3,647,210 | 3/1972 | Ratcliffe | 272/132 |
| 3,731,917 | 5/1973 | Townsend | 272/69 |
| 3,802,701 | 4/1974 | Good, Jr. | 272/140 |
| 4,349,192 | 9/1982 | Lambert, Jr. et al. | 272/118 |
| 4,402,504 | 9/1983 | Christian | 272/118 |
| 4,456,245 | 6/1984 | Baldwin | 272/134 |
| 4,538,807 | 9/1985 | Rice | 272/134 |
| 4,546,970 | 10/1985 | Mahnke | 272/118 |
| 4,733,860 | 3/1988 | Steffee | 272/134 |

FOREIGN PATENT DOCUMENTS

| | | | |
|---|---|---|---|
| 60-180461 | 11/1985 | Japan . | |
| 60-236668 | 11/1985 | Japan . | |
| 60-182072 | 12/1985 | Japan . | |
| 60-182073 | 12/1985 | Japan . | |
| 82/02668 | 8/1982 | World Int. Prop. O. | 272/134 |

*Primary Examiner*—Robert Bahr

*Attorney, Agent, or Firm*—Bachman & LaPointe

[57] ABSTRACT

An apparatus for training a waist portion of a human body is disclosed. In the apparatus, sprockets are installed on a portion on which a trainer sits and on another portion which his hands grasp, a drive chain extends between the sprockets so as to drive the sprockets in mutually opposite directions. Therefore, transmission loss of the pivotal energy between the two portions is reduced. In addition, a brake drum and pair of brake shoes are provided to adjust resistance to the pivotal movements between the portions, therefor adjustment of the resistance can be achieved without electrical power.

14 Claims, 3 Drawing Sheets

APPARATUS FOR TRAINING A WAIST PORTION OF A HUMAN BODY

BACKGROUND OF THE INVENTION

The present invention relates generally to an apparatus for training a waist portion of a human body, and more particularly relates to a physical instrument for exerting muscles to overcome a resistance to rotational motion of the waist portion of the human body.

A waist twisting motion is a kind of muscle training that is one of the basic physical exercises for a human body. A waist twisting motion carried out with the aid of the training apparatus has an effect on the expansion and constriction of oblique abdominal muscles and sterratus anteriors, latissimus dorsi, trapezius, fascia infraspinata, teres minor, and teres major, as well as the straight abdominal muscles of a human body. By this, the muscle strength can be increased and waist portion becomes thinner.

Such training apparata have commonly been proposed and put into practice. Japanese Utility Model Applications First PUblications (Jikkai) Sho 60-180461, sho 60-182072, sho 60-182073 and a Japanese Patent Application file No. sho 59-93589 disclose such structures of the training apparata.

These training apparata are formed like chairs in which a first portion on which a trainer sits and a second portion having handgrasps, are rotated through a predetermined angle in mutually opposite directions. In addition, pulleys are provided on the first and second portions, a belt extends between the pulleys so that the first and second portions can be caused to pivot in opposite directions thereby. Furthermore, a damper is provided to apply resistance to the pivotal movements of the first and second portions.

However, since the first and second portions are connected through the pulley and pulley belt, a transmission loss of the driving force between the first and second portions is generated by the belt and pulleys. In addition, since the damper uses, electrical power, power consumption accompanies use of the above-described training apparata and also production costs are increased because of the damper.

SUMMARY OF THE INVENTION

It is an object of the present invention to provide an improved apparatus for training a waist portion of a human body.

It is another object of the present invention to provide a compact and cost reduced apparatus for training the waist portion of the human body which is suitable for a home use.

It is still another object of the present invention to provide a more quiet, easily manufactured apparatus for training the waist portion of the human body in which a transmission loss of pivotal movements of a portion on which a trainer sits and another portion on which a trainer's hands are grasped is reduced.

These objects can be achieved by providing an apparatus comprising: (a) a base table portion having a first shaft vertically extending from the base table; (b) a first portion disposed so as to be grasped by human hands and capable of being pivoted in a first direction through a first predetermined angle and in an opposite direction to the first direction through the first predetermined angle; (c) a second portion disposed so that a human's lower portion can be supported thereon and capable of being pivoted in a second direction opposite to the first direction through a second predetermined angle when the first portion is pivoted in the first direction and in the opposite direction to the second direction through the second predetermined angle when the first portion is pivoted in the opposite direction to the first direction; (d) a first sprocket member responsive to a first external force for pivoting the first portion in either first or opposite direction thereto according to a direction of the first external force; (e) a second sprocket member responsive to a second external force for pivoting the second portion in either the second or opposite direction thereto according to a direction of the second external force; and (f) an endless drive chain member engaged with both first and second sprocket members via a pair of roller members.

DETAILED DESCRIPTION OF THE PREFERRED EMBODIMENT

Reference will hereinafter be made to the drawings in order to facilitate understanding of the present invention.

FIGS. 1 to 6 show a preferred embodiment of an apparatus for training a waist portion of a human body.

Figure 1:
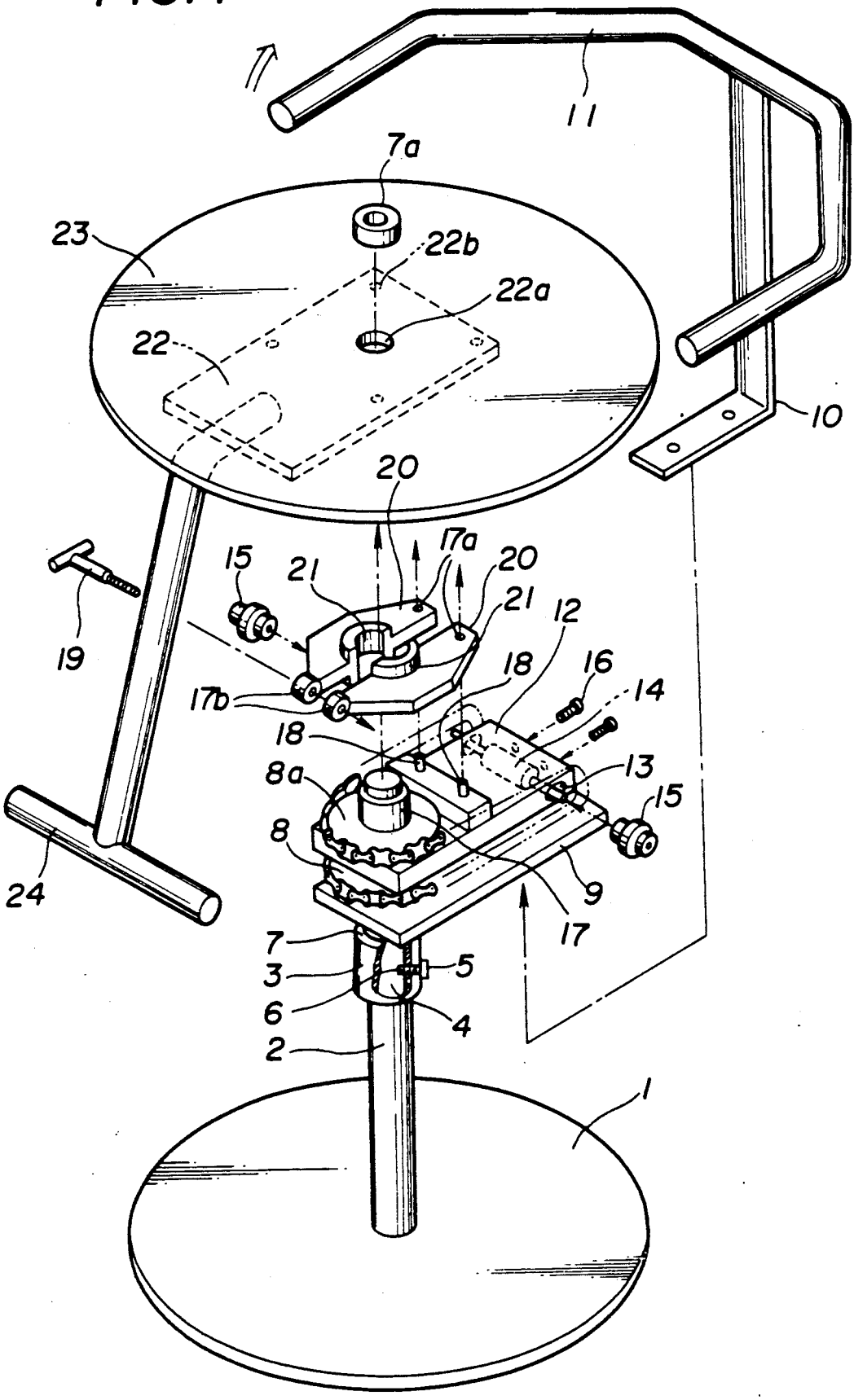
FIG. 1 is an exploded perspective view of an apparatus for training a waist portion of a human body in a preferred embodiment according to the present invention.
Figure 2:
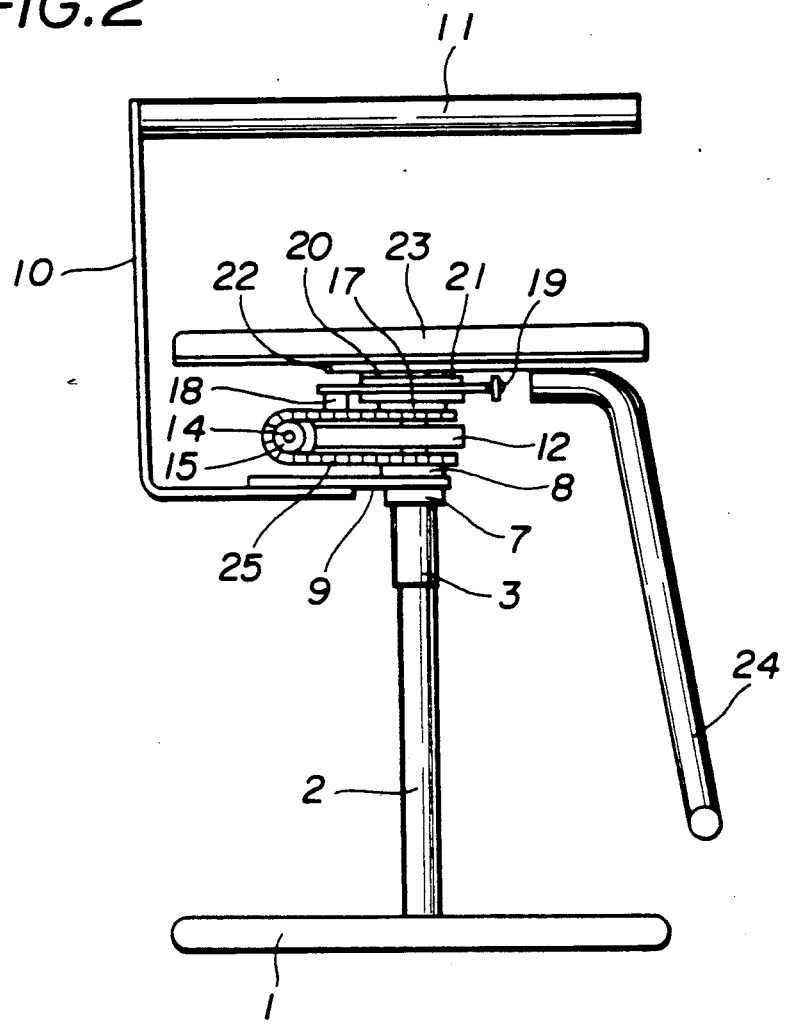
FIG. 2 is a side view of the training apparatus shown in FIG. 1.
Figure 3:
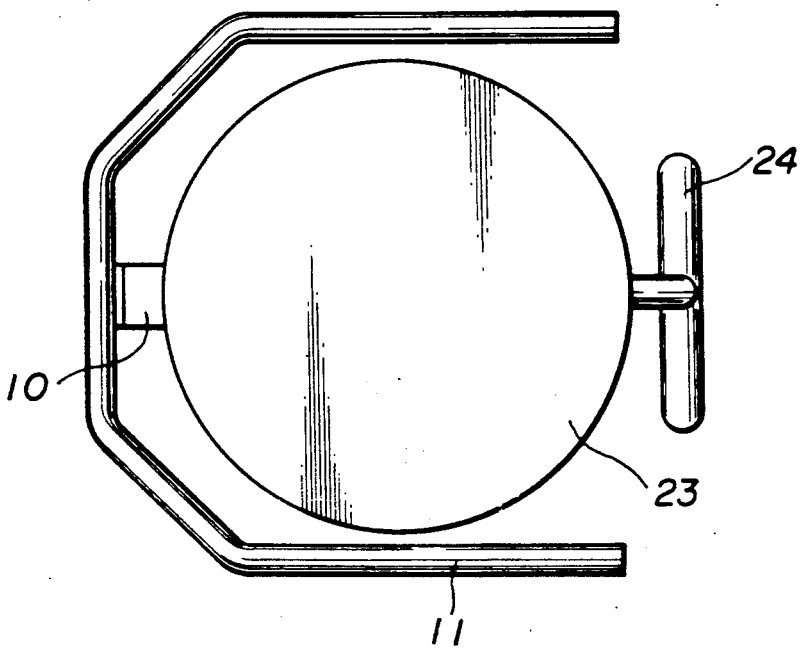
FIG. 3 is a top view of the training apparatus.

In FIG. 1, a base table 1 and a leg 2 are integrally linked with each other. The base table 1 an leg 2 form a chair leg. An upper end of the leg 2 is provided with a bearing envelope 3. The bearing envelope 3 is formed so as to have a letter-U shaped cross section. The lower end of a shaft 4 extended in the same direction as the leg 2 is fitted into the bearing envelope 3. The bearing envelope 3 is provided with a threaded hole 6 at a side surface thereof. A screw 5 is used to lock the shaft 4 in the bearing envelope 3 so as to prevent the shaft 4 from rotating or being pulled out. In addition, a stopper ring 7 contacting an upper end surface of the bearing envelope 3 is fixed around the shaft 4. A sprocket 8 is loosely fitted around a portion of the shaft 4 which is located above the stopper ring 7 so as to be axially supported thereon. A plate 9 is integrally linked with the sprocket 8 extends radially from the shaft 4. The plate 9 is pivotable together with the sprocket 8. An arm 10 is linked with the plate 9. The arm 10 supports a horizontally elongated arm 11 for supporting an elbow portion of the human body. One horizontal end of a box 12 is fixed to a portion of the shaft 4 which is located above on end of the sprocket 8 perpendicularly to the shaft 4. The other horizontal end of the box 12 is provided with elliptically shaped holes 13 at opposing side surfaces. A shaft 14 is inserted in the box 12 through the opposing holes 13.

The ends of the shaft 14 project from both side surfaces of the box 12. Reversibles roller 15 are rotatably supported on each end of the shaft 14. Adjustment screws 16 are inserted through the other end of the box 12 for adjustably moving the shaft 14 in the longitudinal direction of the box 12. On the other hand, a sprocket 8*a* is loosely fitted to a portion of the shaft 4 which is located above an upper end of the box 12. A brake drum 17 is integrally formed on the sprocket 8*a*. The brake drum 17 is grasped with a pair of brake plates 20, of the brake plates 20 are pivotally supported at one end on supporting pins 18 which project from the box 12 through holes 17*a* and the other ends of the brake plates 20 being tightened by means of a screw 19 which is inserted through a pair of opposing holes 17*b*.

It is noted that one of the pair of holes 17*b* through which the fixture 19 is inserted has no threaded portion. It is also noted that each semi-circular slide contact surfaces of the pair of brake plates 20 are provided with a brake shoe 21 on which a lubricant of a silicone series, fluorine series, or oil series is coated. A stopper ring 7*a* is fixed to an upper end of the shaft 4. In addition, a portion of the shaft 4 which is located above the sprocket 8*a* and an upper end of the brake drum 17, is fitted into a hole 22*a* of the mounting plate 22 and the upper portion of the shaft 4 is welded therein. A large-diameter circular table 23 is horizontally fixed to the upper surface of the mounting plate 22 with screws to inserted into threaded holes. A T-bar shaped arm 24 extends downwardly from the mounting plate 22 so as to support human feet.

Figure 4:
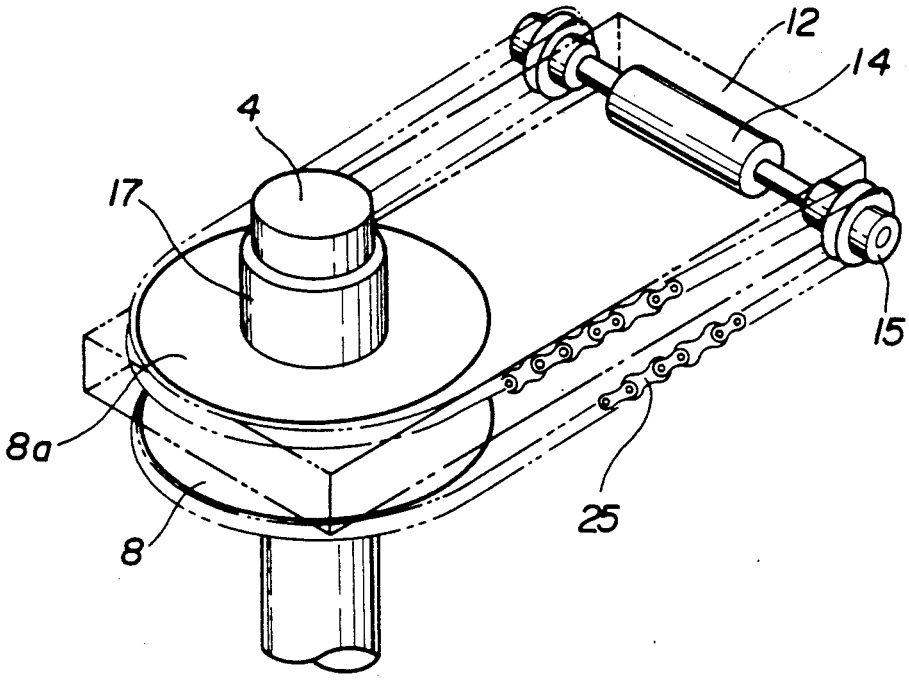
FIG. 4 is an explanatory view of a relationship between a shaft, sprockets, and chain belt of the training apparatus shown in FIGS. 1 and 2.

As shown in FIG. 4, an endless drive chain 25 extends between the reversible rollers 15, 15 via the sprockets 8, 8*a*. The two sprockets 8, 8*a* can rotate in opposite directions through a predetermined angle (about 120 degrees). A total of four metal fittings 26 intervene between each end of the linked chain belt 25 for forming twists in the drive chain 25.

Figure 5:
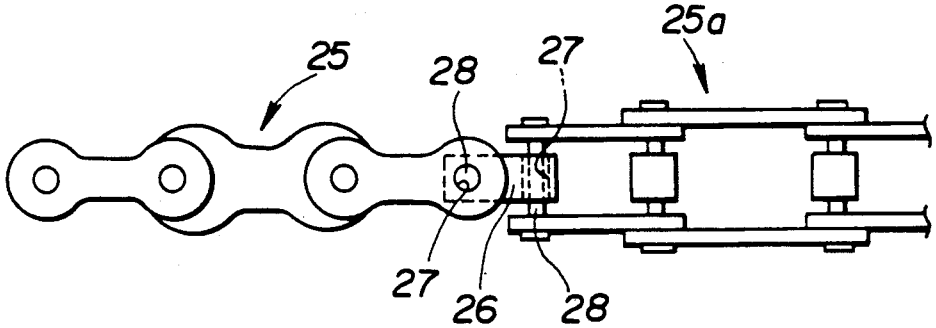
FIG. 5 is a partial top view of the chain belt shown in FIGS. 1, 2, and 4.

As shown in FIG. 5, each metal linkage fitting 26 comprises a small-sized metal strip, both ends thereof having holes through which pins 28 of the adjacent chain belts 25, 25*a* penetrate and one of the pins 28, 28 being perpendicular to the other pin 28, 28 so that the adjacent chain belts 25, 25*a* are joined together and twisted through a right angle.

Figure 6:
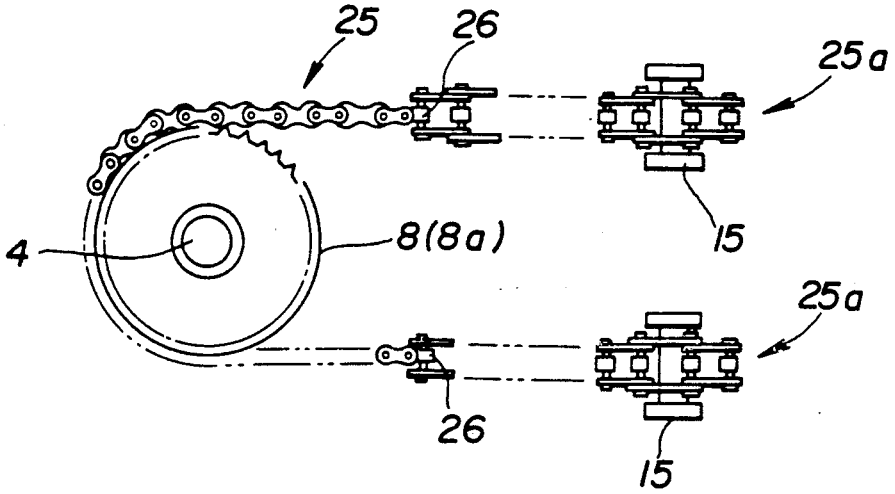
FIG. 6 is a partial top view of the shaft, sprockets, chain belt, and reversible chain belt shown in FIGS. 1, 2, 4, and 5.

As shown in FIG. 6, the metal fittings 26 intervene at center positions between the sprockets 8, 8*a* and reversible rollers 15.

The linked chain belt 25 is engaged with the sprocket 8, and thereafter engaged with the reversible rollers 15 and then engaged with the sprocket 8*a*. The tension of the linked chain belt 25 is adjustable by means of the adjustment screws 16.

Next, an operation of the preferred embodiment will hereinafter be described below.

A trainer sits on the large-diameter circular table 23 with both soles of the trainer's feet supported on the T-bar shaped arm 24, both of his arms supported on the horizontally elongated arm 11 and both hands grasping it.

After the above-described posture is assumed, he twists at the waist. When the upper half of his body rotates in a clockwise direction, the horizontally elongated arm 11 is pivoted in the clockwise direction as denoted by an arrow mark, the sprocket 8*a* is rotated via the chain belt 25 in a counterclockwise direction, i.e., the opposite direction of the rotation of the horizontally elongated arm 11 and the circular plate 23 on which he sits is accordingly rotated in the counterclockwise direction so that a lower half of his body is twisted in the counterclockwise direction.

On the contrary, when the upper half of his body is twisted in the counterclockwise direction, the lower half of his body is, in turn, twisted in the clockwise direction.

In this way, the trainer can make a twisting motion sitting on the circular plate 23. Through such repeated twisted motions, the abdominal muscles, latissimus dorsi, trapezius, teres monir, teres major, and oblique adbominal muscle are expanded and constricted and fat adjacent to those muscles is consumed as muscle's energy.

On the other hand, if a speed or load adjustment is required for such twisting motion, the fixture 19 for the brake pads 20 is used to fasten the brake pads 20 to adjust the compression force of the brake shoes 21 against the brake drum 17. In addition, if the chain belt 25 becomes loose, the adjustment screws 16 are rotated to move the shaft 14 so that the tension is given to the chain belt 25 in the opposite direction of the sprockets 8, 8*a* since the adjustment screws 16 are threaded into female threaded portions provided on large-diameter shaft portion of the shaft 14.

As described hereinabove, in the apparatus for developing the waist portion of a human body according to the present invention, the chain belt is pivoted between the sprockets for the large-diameter circular plate and for the horizontally elongated arm. A transmission of a pivotal force of the chain belt is assured with reduced transmission loss and therefore the apparatus provides a favorable physical efficiency. In addition, since the brake drum is formed on either of the two sprockets and brake means comprising the pair of brake shoes for grasping the brake drum is provided in the training apparatus, the load adjustment on the movement of the circular plate is easily achieved through the fixture 19. Therefore, since no motor for the load adjustment is needed, the production cost and power consumption are reduced. Furthermore, since the reversible roller is made of elastic material, noise is reduced. In this way, the training, apparatus according to the present invention is easy to construct, compact, and is suitable for home use.

It will fully be understood by those skilled in the art that the foregoing description is made in terms of the preferred embodiment and various changes and modifications may be made without departing from the scope of the present invention which is to be defined by the appended claims.

What is claimed is:

1. A waist training apparatus, comprising:

(a) first means defining a base member having shaft means vertically extending therefrom;

(b) second means defining a seat portion having foot support means extending therefrom, said second means being connected to said shaft means at a first point;

(c) third means defining an arm portion of the chair to enable grasping by a humans hands with the human body rested on the second means, said arm portion having means extending therefrom for connecting said third means to said shaft means at a second point spaced from said first point;

(d) fourth means disposed between said first point and said second point and proximate thereto and connected to said shaft means for operatively pivoting the second means and third means mutually in opposite directions according to a twisting action of the humans body; and (e) fifth means located proximate to said fourth means for applying an adjustable load required to pivot said first and second means.

2. The waist training apparatus as set forth in claim 1, wherein the fourth means comprises at least two sprocket members, one associated with the first means and the other associated with the second means, an endless driven chain member engaged with peripheral portions of the two sprocket members for transmitting the pivoting movements of the seat portion to the second arm portion so as to pivot in the opposite direction and vice versa via a pair of roller members rolled on a shaft.

3. The waist training apparatus as set forth in claim 1, wherein each sprocket member is connected to a plate member, said plate member being provided with a shaft linked with a pair of roller members, wherein a plane defined by the rotational directions of the roller members is orthogonal to that defined by the rotational directions of the sprocket members.

4. The waist training apparatus as set forth in claim 3, wherein said fifth means comprises a brake pad disposed between the first member and the seat portion of the first means for generating a frictional force as the adjustable load.

5. An apparatus comprising:

(a) a base table portion having a first shaft vertically extending from the base table portion;

(b) a first portion disposed above the base table portion so as to enable grasping by human hands and capable of being pivoted in a first direction through a first predetermined angle and in an opposite direction to the first direction through the first predetermined angle;

(c) a second portion disposed above the base table portion and against the first portion so that a human's lower portion can be supported thereon and capable of being pivoted in a second direction opposite to the first direction through a second predetermined angle when the first portion is pivoted in the first direction and in the opposite direction to the second direction through the second predetermined angle when the first portion is pivoted in the opposite direction to the first direction;

(d) a first sprocket member associated with the first portion and connected to the first shaft of the base table portion and responsive to a first external force for pivoting the first portion in either the first or opposite direction thereto according to a direction of the first external force;

(e) a second sprocket member associated with the second portion and connected to the first shaft of the base table portion and responsive to a second external force derived by a twisting motion of the human's body for pivoting the second portion in either the second or opposite direction thereto according to a direction of the second external force;

(f) as endless drive chain member engaged with both of said first and second sprocket members via a pair of roller members; and (g) brake means formed integrally with and adjacent to at least one of the first and second sprocket members for adjustably applying a load onto the corresponding first or second sprocket member in order to resist rotation.

6. An apparatus as set forth in claim 5, wherein the drive chain member assists in defining the first predetermined angle through which the first portion is pivoted.

7. An apparatus as set forth in claim 6, wherein the drive chain member assists in defining the second predetermined angle through which the second member is pivoted.

8. An apparatus as set forth in claim 5, wherein the pair of roller members are made of elastic materials.

9. An apparatus as set forth in claim 7, wherein the drive chain belt includes a fixture for allowing a twist of 90 degrees so that the first and second predetermined angles through which both first and second portions are pivoted are defined.

10. An apparatus as set forth in claim 1, wherein the brake means includes a pair of opposing brake shoes attached onto the first shaft of the base table portion and a fixture for adjusting a braking force of the braking means.

11. An apparatus as set forth in claim 5, which further comprises a second shaft member to which the opposing rollers are movably fixed at opposing ends thereof and adjustment means adjustably fixed to the second shaft member for adjusting a tension of the chain belt.

12. An apparatus as set forth in claim 11, wherein the adjustment means comprises a threaded screw engaged with the second shaft member via a female threaded hole to adjust a distance between the opposing two rollers and either of the sprocket members.

13. An apparatus comprising:

(a) a base table portion having an upstanding shaft means vertically extending from the base table portion;

(b) a first portion connected to said shaft means at a first point so as to enable grasping by human hands and capable of being pivoted in a first direction through a first predetermined angle in an opposite direction to the first direction through the first predetermined angle;

(c) a second portion connected to said shaft means at a second point spaced from said first point so that a humans lower portion can be supported thereon and capable of being pivoted in a second direction opposite to the first direction through a second predetermined angle when the first portion is pivoted in the first direction and in the opposite direction to the second direction through the second predetermined angle when the first portion is pivoted in the opposite direction to the first direction;

(d) a first sprocket member proximate to and associated with the first portion and connected to the upstanding shaft means of the base table portion at a point between said first and second points and responsive to a first external force for pivoting the first portion in either the first or opposite direction thereto according to a direction of the first external force;

(e) a second sprocket member proximate to and associated with the second portion and connected to the upstanding shaft means of the base table portion at a point between said first and second points and responsive to a second external force derived by a twisting motion of the humans body for pivoting the second portion in either the second or opposite direction thereto according to a direction of the second external force; and (f) an endless drive chain member engaged with both of said first and second sprocket members via a pair of rollers.

14. An apparatus as set forth in claim 13, further including brake means proximate to at least one of the first and second sprocket means and connected to said shaft means of the base table portion at a point between said first and second points.

* * * * *